United States Patent [19]

Cole

[11] 4,133,536

[45] Jan. 9, 1979

[54] BINGO CARD HOLDING AND MARKING DEVICE

[76] Inventor: Charles Cole, 7928 S. Sayre, Burbank, Ill. 60459

[21] Appl. No.: 789,822

[22] Filed: Apr. 22, 1977

[51] Int. Cl.[2] ..... A63F 3/06

[52] U.S. Cl. ..... 273/240; 273/269; 273/309

[58] Field of Search ..... 273/135 B, 136 E, 136 G, 273/136 H, 240, 269, 309; 40/158 R; 281/45

[56] References Cited

U.S. PATENT DOCUMENTS

| | | | |
|---|---|---|---|
| 2,283,026 | 5/1942 | Yates | 40/158 R X |
| 2,872,215 | 2/1959 | Taylor | 273/136 G X |
| 3,101,947 | 8/1963 | Dzuris | 273/136 A |
| 3,602,513 | 8/1971 | Breen | 273/135 B |
| 3,720,130 | 3/1973 | Holson | 40/158 R X |
| 3,811,680 | 5/1974 | Benesch | 273/136 G |

*Primary Examiner*—Anton O. Oechsle
*Attorney, Agent, or Firm*—Daniel Jay Tick

[57] ABSTRACT

A transparent plastic sheet having a plurality of groups of circular holes formed therethrough and an adhesive coating is releasably mounted on a plurality of bingo cards releasably secured to an adhesive coating on a backing plate to permit working of the numbers of each of the bingo cards so that a bingo player may play a plurality of bingo cards simultaneously.

2 Claims, 3 Drawing Figures

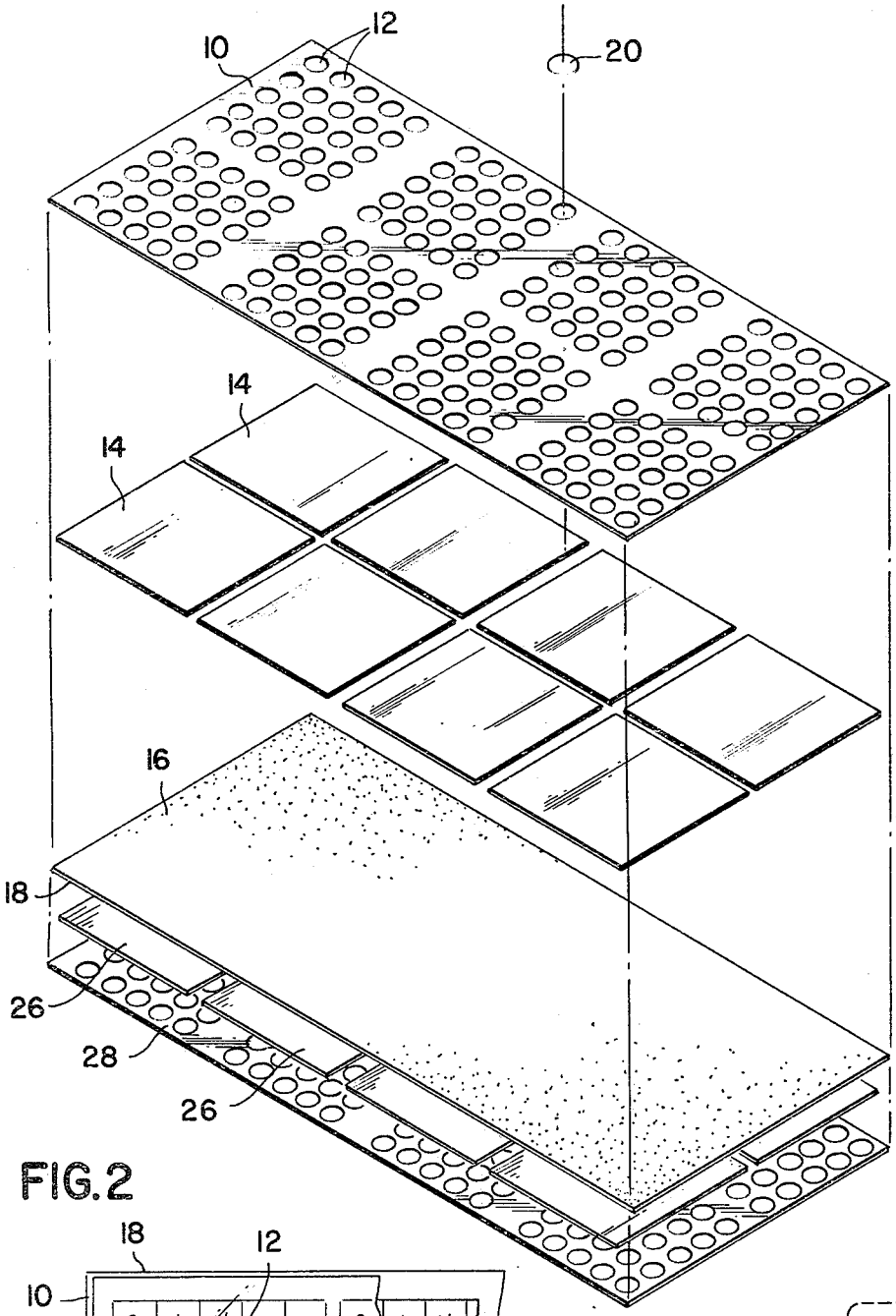
FIG. 1
FIG. 2
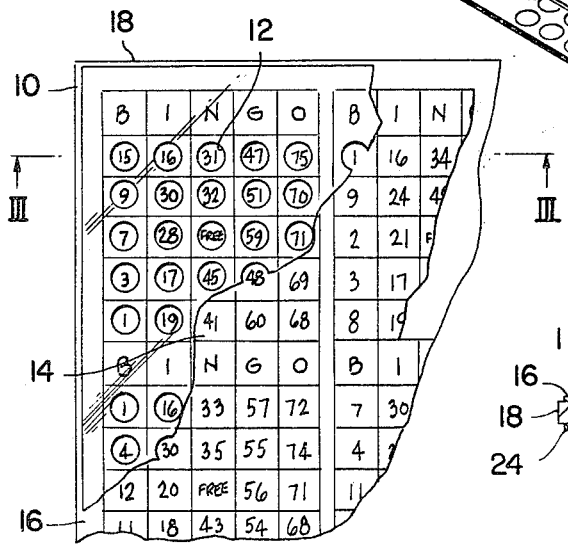
FIG. 3
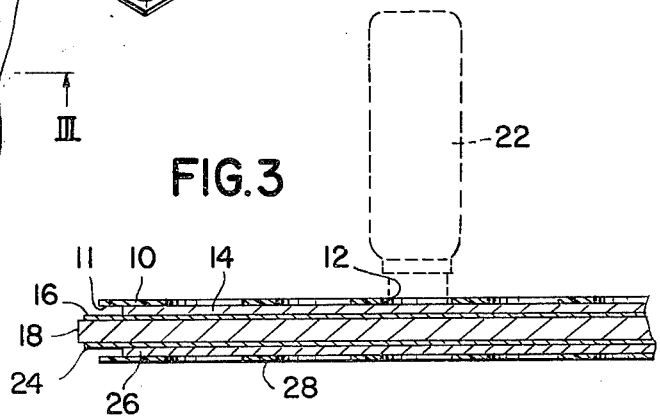

BINGO CARD HOLDING AND MARKING DEVICE

BACKGROUND OF THE INVENTION

The present invention relates to a bingo card holding and marking device.

The bingo card holding and marking device of the invention retains a plurality of bingo cards in position to permit marking thereof with a marker or via a dauber. A bingo player is thus enabled to play a plurality of bingo cards simultaneously without losing his or her place, and without misplacing or losing any of the bingo cards. The holding and marking device of the invention is also usable to play games similar to bingo, using similar playing cards.

The bingo card holding and marking device comprises a transparent plastic sheet consisting of an acetate material with an adhesive coating for covering the faces of the bingo cards. The cards are releasably secured to a backing plate via an adhesive coating on the backing plate. The transparent acetate sheet has a plurality of circular holes formed therethrough for accommodating a dauber to mark the numbers on the cards, or in which markers are placed to indicate the called numbers on the various bingo cards.

The punched holes are large enough to enable the dauber to easily fit therethrough and thereby reduce the probability of marking the transparent sheet during the marking of the number. A preferred embodiment of the device of the invention is of sufficient size to cover eight bingo cards or eight special playing cards, simultaneously.

BRIEF DESCRIPTION OF THE DRAWINGS

In order that the invention may be readily carried into effect, it will now be described with reference to the accompanying drawings, wherein:

FIG. 1 is an exploded perspective view of an embodiment of the bingo card holding and marking device of the invention;

FIG. 2 is a top plan view, on an enlarged scale, partly cut away, of the embodiment of FIG. 1, assembled and in use; and FIG. 3 is a cross-sectional view, on an enlarged scale, taken along the lines III—III, of FIG. 2.

DETAILED DESCRIPTION OF THE INVENTION

The bingo card holding and marking device of the invention functions to retain a plurality of bingo cards 14 and 26 in position to permit marking thereof by markers 20 (FIG. 1) or by a dauber 22 (FIG. 3). Each of the bingo cards 14 or 26, in the usual manner of bingo cards, has a face with a plurality of numbers thereon in rows and columns, as shown in FIG. 2.

The bingo card holding and marking device of the invention comprises a backing plate 18 having spaced opposite first and second substantially planar surfaces each accommodating a plurality of bingo cards 14 or 26, respectively, thereon in rows and columns. Although eight bingo cards 14 or 26 may be accommodated on each surface of the backing plate 18, as shown in FIG. 1 for the purposes of illustration, a lesser or greater number of cards are accommodatable on either surface of the backing plate, dependent upon its dimensions.

An adhesive coating 16 is provided on the first surface of the backing plate 18 for releasably securing a plurality of bingo cards 14 thereto with their faces up, as shown in FIGS. 1 to 3.

An adhesive coating 24 is provided on the second surface of the backing plate 18 for releasably securing a second plurality of bingo cards 26 thereto with their faces up, as shown in FIGS. 1 and 3.

A transparent plastic sheet 10 (FIGS. 1 to 3) has a plurality of groups of circular holes 12, formed therethrough in rows and columns corresponding to the bingo cards. Each group of holes 12 has a plurality of circular holes in rows and columns corresponding to the numbers on the face of a bingo card, as shown in FIGS. 1 and 2.

An adhesive coating 11 (FIG. 3) is provided on the transparent sheet 10 for releasably securing said transparent sheet to the bingo cards 14 secured to the first surface of the backing plate 18, as shown in FIG. 3, with the holes 12 of said transparent sheet in alignment with the numbers of said bingo cards, thereby permitting marking of the numbers of said bingo cards.

A second transparent plastic sheet 28 (FIGS. 1 and 3) has a plurality of circular holes formed therethrough in rows and columns corresponding to the second plurality of bingo cards 26. Each group of holes has a plurality of circular holes in rows and columns corresponding to the numbers on the face of a bingo card, as shown in FIG. 1.

An adhesive coating (FIG. 3) is provided on the second transparent sheet to the bingo cards 26 secured to the second surface of the backing plate, as shown in FIG. 3, with the holes of said transparent sheet in alignment with the numbers of said bingo cards, thereby permitting marking of the numbers of said bingo cards.

Either or both groups of bingo cards 14 and 26 may be played simultaneously.

Any playing cards may be used instead of the bingo cards, thereby permitting the playing of games other than bingo.

Having described a preferred embodiment of my invention, it is understood that various changes can be made without departing from the spirit of my invention, and, I desire to cover by the appended claims all such modifications as fall within the true spirit and scope of my invention.

What I claim and seek to secure by Letters Patent is:

1. A bingo card holding and marking device for retaining a plurality of bingo cards in position to permit marking thereof, each of the bingo cards having a face with a plurality of numbers thereon in rows and columns, said bingo card holding and marking device comprising a backing plate having spaced opposite first and second substantially planar surfaces each accommodating a plurality of bingo cards thereon in rows and columns;

an adhesive coating on the first surface of the backing plate for releasably securing a plurality of bingo cards thereto with their faces up;

a transparent plastic sheet having a plurality of groups of circular holes formed therethrough in rows and columns corresponding to the bingo cards, each group having a plurality of circular holes in rows and columns corresponding to the numbers on the face of a bingo card; and an adhesive coating on said transparent sheet for releasably securing said transparent sheet to the bingo cards secured to the first surface of said backing plate with the holes of said sheet in alignment with the numbers of said cards thereby permitting marking of the numbers of said bingo cards.

2. A bingo card holding and marking device as claimed in claim 1, further comprising an adhesive coating on the second surface of said backing plate for releasably securing a second plurality of bingo cards thereto with their faces up, a second transparent plastic sheet having a plurality of groups of circular holes formed therethrough in rows and columns corresponding to the second plurality of bingo cards, each group of holes having a plurality of circular holes in rows and columns corresponding to the numbers on the face of a bingo card, and an adhesive coating on said second transparent sheet for releasably securing said second transparent sheet to the bingo cards secured to the second surface of said backing plate thereby permitting marking of the numbers of said second plurality of bingo cards.

* * * * *